US007755656B2

(12) United States Patent
Loh et al.

(10) Patent No.: US 7,755,656 B2
(45) Date of Patent: Jul. 13, 2010

(54) SYSTEMS AND METHODS FOR ADJUSTING LOADING OF MEDIA ONTO A PRINT SURFACE

(75) Inventors: Beverly Loh, Vancouver, WA (US); Jason Charles Grosse, Vancouver, WA (US); Christopher M. Lesniak, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 714 days.

(21) Appl. No.: 11/686,627

(22) Filed: Mar. 15, 2007

(65) Prior Publication Data

US 2008/0225103 A1 Sep. 18, 2008

(51) Int. Cl.
*B41J 11/00* (2006.01)

(52) U.S. Cl. ..... 347/172

(58) Field of Classification Search ..... 347/172, 347/198, 215, 218, 220, 221
See application file for complete search history.

(56) References Cited

U.S. PATENT DOCUMENTS

| | | | | |
|---|---|---|---|---|
| 5,609,428 | A | 3/1997 | Tanaka et al. | |
| 5,812,158 | A * | 9/1998 | Murthy et al. | 347/45 |
| 6,416,159 | B1 * | 7/2002 | Floyd et al. | 347/21 |
| 6,945,721 | B2 | 9/2005 | Sato | |
| 2002/0037191 | A1 | 3/2002 | Lesniak et al. | |
| 2008/0012887 | A1 * | 1/2008 | Maeno et al. | 347/9 |
| 2008/0074473 | A1 * | 3/2008 | Takabe et al. | 347/70 |

OTHER PUBLICATIONS

International Search Report in co-pending PCT Application No. PCT/US2008/054845 (Jun. 2008).

* cited by examiner

*Primary Examiner*—K. Feggins

(57) ABSTRACT

In one embodiment, a system and method pertains to detecting a position of a sheet of media that has been loaded onto the print surface, determining from the detected position a current loading error with which the media sheet has been loaded onto the print surface, and calculating a loading offset that can be used to adjust the position at which a future media sheet will be loaded onto the print surface.

20 Claims, 6 Drawing Sheets

SYSTEMS AND METHODS FOR ADJUSTING LOADING OF MEDIA ONTO A PRINT SURFACE

BACKGROUND

In some printing devices, it is necessary to precisely control the placement of print media on a print surface. For example, some printing devices comprise a print drum that defines the print surface and that includes media hold-down features with which the media must precisely align in order to properly adhere the media to the drum during printing and accurately remove the media from the drum after printing has been completed. Although firmware of a printing device may be configured to accurately position the media on the drum, various factors can result in the media being placed out of position on the drum. For example, mechanical part tolerances of the print mechanism, part wear, and/or slippage of the media along the media path can result in the media being misapplied to the drum.

BRIEF DESCRIPTION OF THE DRAWINGS

The disclosed systems and methods can be better understood with reference to the following drawings. The components in the drawings are not necessarily to scale.

DETAILED DESCRIPTION

As described above, the accuracy with which media can be loaded onto a print surface of a printing device can be decreased due to various factors. As described in the following, however, that accuracy can be increased by calibrating the printing device to take such factors into account. In some embodiments, the difference between a desired position of media on the print surface and an actual position of the media on the print surface is used to generate a loading offset that can be used to adjust the position at which subsequent media sheets are loaded onto the print surface. In some loading embodiments, the loading offset is derived relative to a moving average of an observed error in the positioning of media on the print surface.

Disclosed herein are embodiments of systems and methods for adjusting loading of media onto a print surface. Although particular embodiments are disclosed, those embodiments are provided for purposes of example only to facilitate description of the disclosed systems and methods. Therefore, the disclosed embodiments are not intended to limit the scope of this disclosure.

Figure 1:
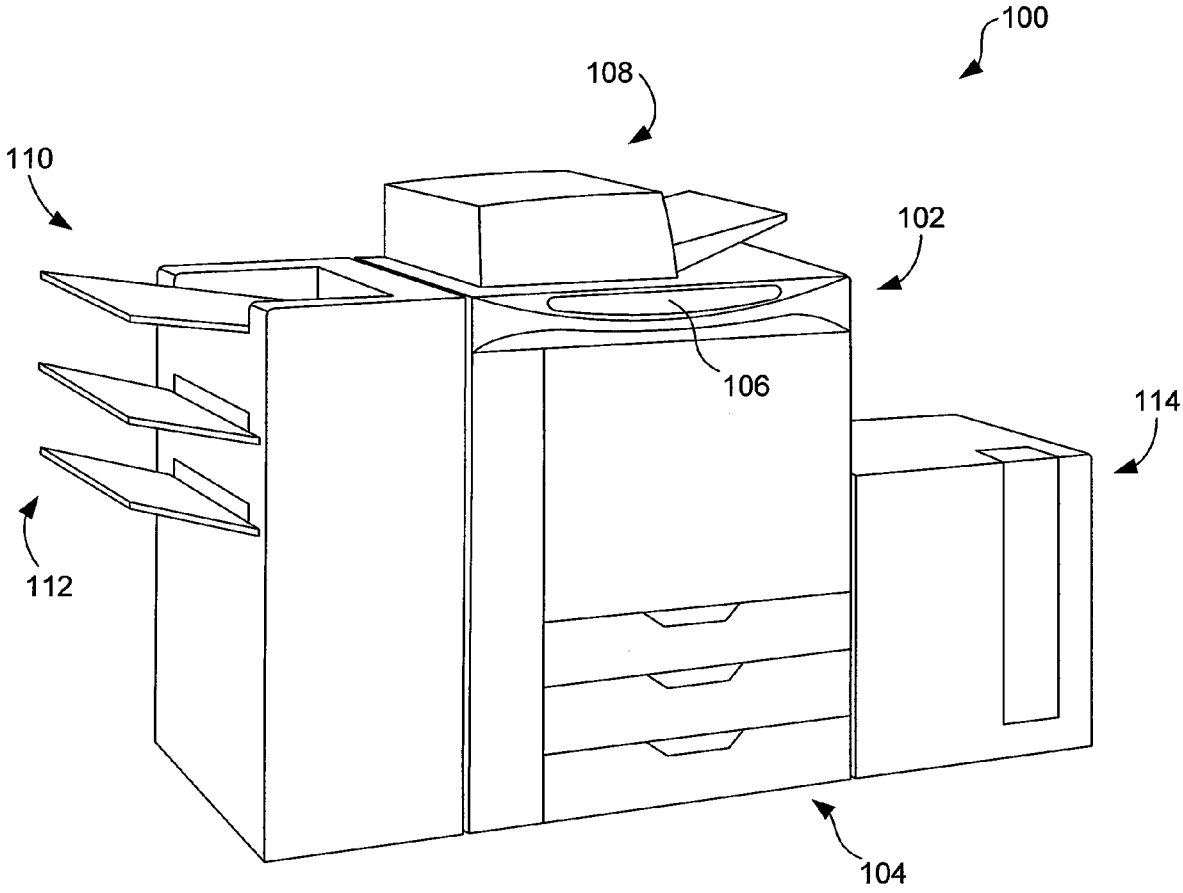
FIG. 1 is a perspective view of an embodiment of a printing device configured to adjust loading of media onto a print surface.

Referring now in more detail to the drawings, in which like numerals indicate corresponding parts throughout the several views, FIG. 1 illustrates an embodiment of a printing device 100. By way of example, the printing device 100 comprises an inkjet printer. Although an "inkjet" printer has been specifically mentioned, it is noted that the printing device 100 could comprise another form of printing device, such as a laser printer. Moreover, although a "printer" has been specifically mentioned, it is noted that the printing device 100 need not be limited to printing functionality alone. For example, in some embodiments, the printing device 100 can provide further functionalities such as copying, faxing, and emailing. In such a case, the printing device 100 may be described as a multifunctional printing device.

As indicated in FIG. 1, the printing device 100 comprises a main printing unit 102 that contains the various internal components of the print mechanism. As described below, those components can comprise one or more inkjet pens configured to eject droplets of ink on a suitable print medium, such as paper. As further indicated in FIG. 1, the main printing unit 102 includes one or more media input trays 104 in which sheets of print media can be loaded. In addition, the printing unit 102 comprises a control panel 106 with which a user can interface to enter various selections that control operation of the printing device 100. Optionally, the print unit 102 further comprises an automatic document feeder 108 with which sheets of media can be automatically positioned on a platen (not shown) of the printing device 100 to enable copying of images provided on that media.

In the embodiment of FIG. 1, the printing device 100 further includes a media output device 110 that comprises one or more media output trays 112 in which printed media can be output from the printing device. In addition, the printing device 100 of FIG. 1 includes a high-capacity media input device 114 that, like the media trays 104, can store media to be input into a media path of the printing device.

Figure 2:
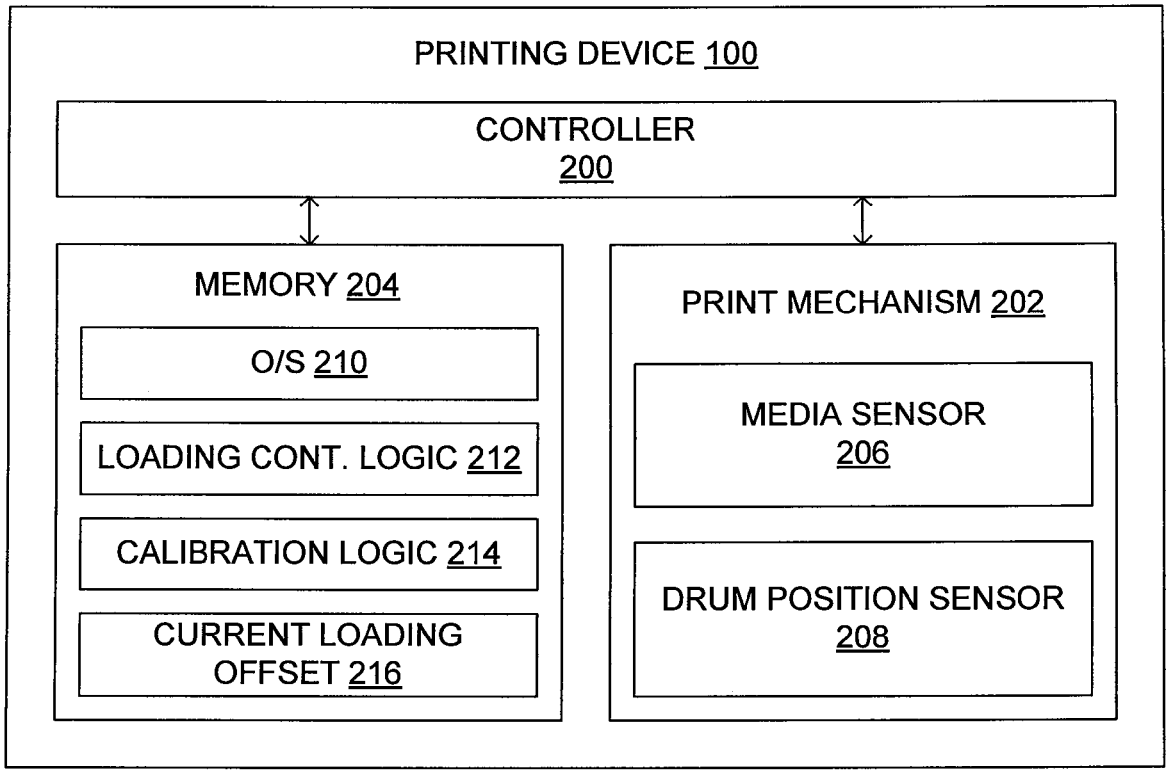
FIG. 2 is a block diagram of an embodiment of the printing device of FIG. 1.

FIG. 2 is a block diagram illustrating an example architecture for the printing device 100 of FIG. 1. As is indicated in FIG. 2, the printing device 100 comprises a controller 200, a print mechanism 202, and memory 204. The controller 200 is adapted to execute commands that control operation of the printing device 100 and can, for example, comprise one or more processors and/or application-specific integrated circuits (ASICs).

As described above, the print mechanism 202 includes various components that are used to perform printing, including, for example, drive motors and associated transmissions, drive rollers, a print drum that defines a print surface, and inkjet pens. As shown in FIG. 2, the print mechanism 202 further includes a media sensor 206 and a drum position sensor 208. Examples for the media sensor 206 and the drum position sensor 208 are described in relation to FIG. 3.

The memory 204 comprises any one or a combination of volatile memory elements (e.g., random access memory (RAM)) and nonvolatile memory elements (e.g., read-only memory (ROM), Flash memory, hard disk, etc.). The memory 204 stores various programs and other logic including an operating system (O/S) 210 that comprises the commands used to control general operation of the printing device 100. In addition, the memory 204 comprises media loading control logic 212 that is used to control the loading of media onto the print drum and, therefore, the drum position at which the media is applied to the drum. The memory 204 further stores calibration logic 214 that is used to determine a loading offset that is used to adjust media loading. As described below, the loading offset is calculated relative to information obtained from the media sensor 206 and the drum position sensor 208 and comprises a distance parameter that is used to adjust the position at which the media is loaded onto the drum. Once calculated by the calibration logic 214, the loading offset can be stored in memory 204, for example nonvolatile memory, as the current loading offset 216. The current loading offset 216 is then used by the loading control logic 212 to adjust loading of the media onto the drum to more accurately position the media on the drum.

Various programs (logic) have been described herein. Those programs can be stored on any computer-readable medium for use by or in connection with any computer-related system or method. In the context of this document, a "computer-readable medium" is an electronic, magnetic, optical, or other physical device or means that contains or stores a computer program for use by or in connection with a computer-related system or method. Those programs can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

Figure 3:
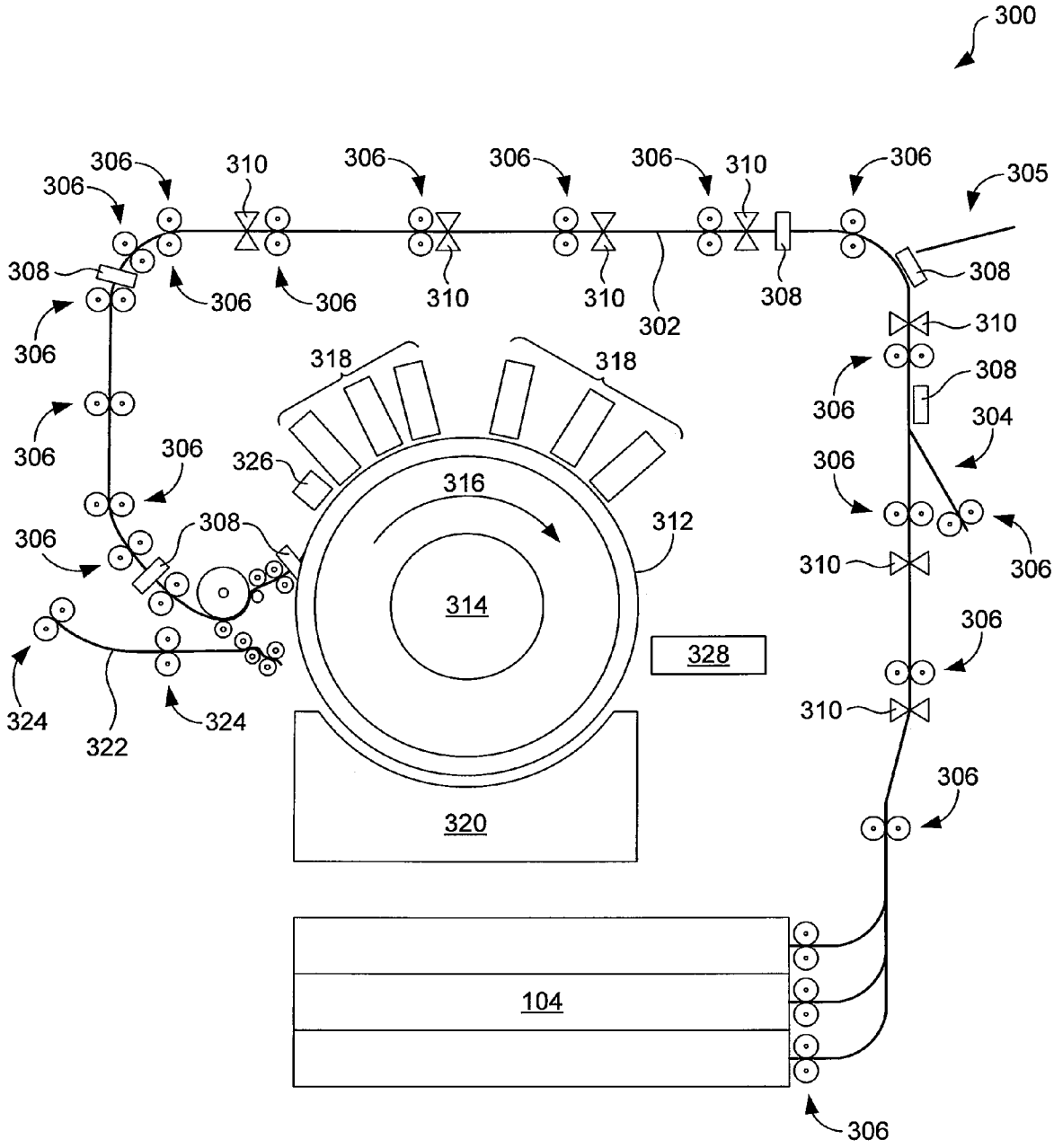
FIG. 3 is schematic view of an embodiment of a print mechanism of the printing device of FIG. 1.

FIG. 3 schematically illustrates an example print mechanism 300 for the printing device 100 of FIG. 1. The print mechanism 300 comprises a media path along which media traverses within the printing device 100. Included in the media path is a print path 302 along which media traverses to reach a print surface described below. In some cases, media can be input into the print path 302 from the input trays 104 first described in relation to FIG. 1. In other cases, media can be input into the print path 302 at a high-capacity input area 304 associated with the high-capacity input tray 114 also shown in FIG. 1. In still other cases, media can be input into the print path 302 at a bypass input area 305 associated with a bypass tray of the printing device 100 (not shown).

Irrespective of how media is input into the print path 302, the media is driven along the path by a plurality of drive rollers 306, which are driven by motors and associated transmissions (not shown) of the print mechanism 100. Positioned at various locations along the print path 302 are sensors that detect the presence, or absence, of media. For example, various optical sensors 308 are provided as are various mechanical sensors 310.

During operation, sheets of print media are driven along the print path 302 toward a print surface 312. In the embodiment of FIG. 3, the print surface 312 is the outer surface of a metal print drum 314 that is rotated by an associated drive motor and transmission (not shown) in the direction indicated by arrow 316. The print surface 312 of the drum 314 can be divided into multiple drum zones with which the sheets of media can be coordinated. Specifically, the leading edges of the media sheets can be aligned with the leading edges of particular drum zones during printing to precisely align the media with media hold-down features of the drum 314 as well as to enable removal of the media from the drum after printing has been completed. In some embodiments, the hold-down features include perforations that are used to apply a vacuum to the media to hold the media in place on the print surface 312.

Figure 4:
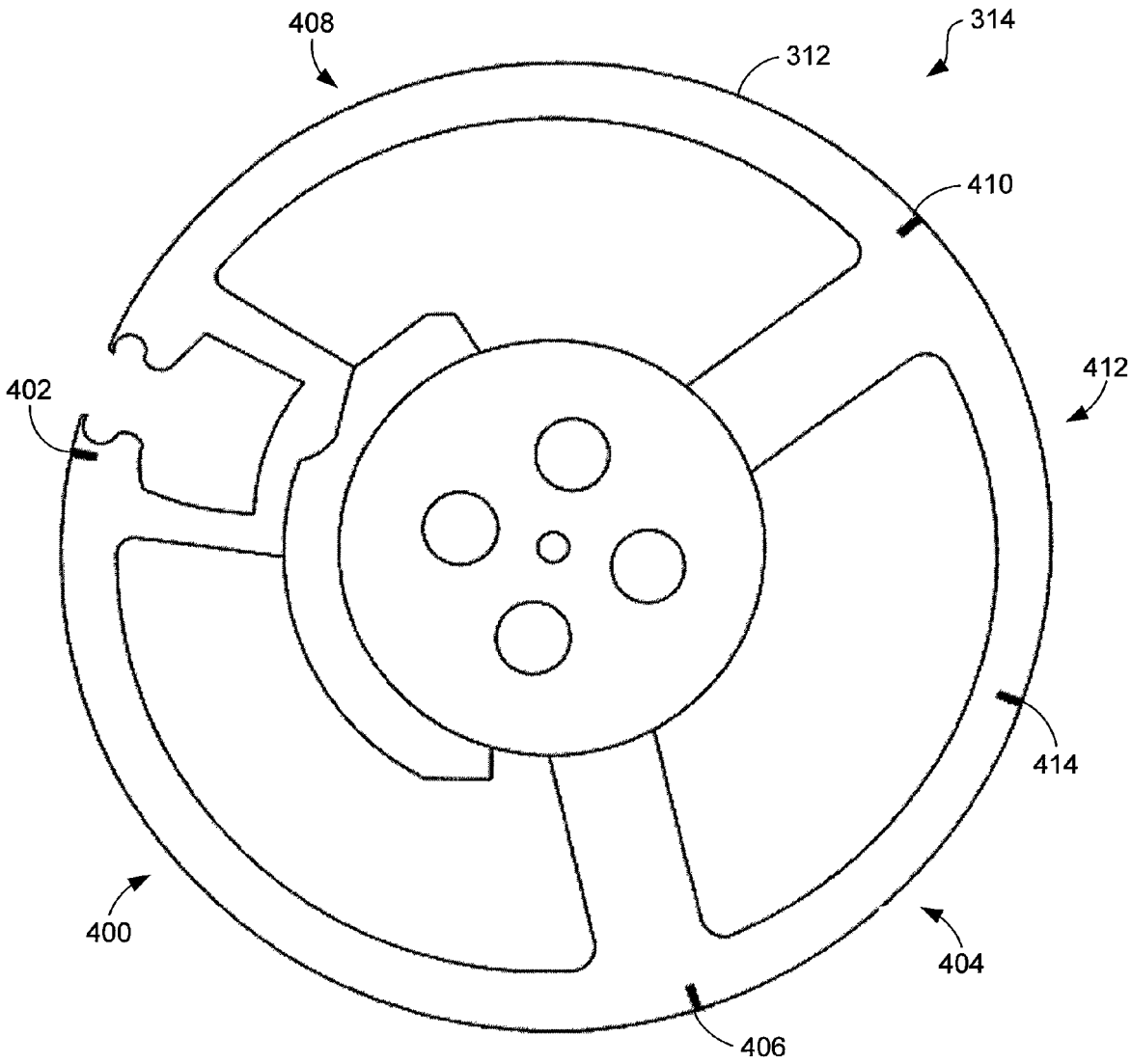
FIG. 4 is a side view of a print drum of the print mechanism of FIG. 3, illustrating different zones of the drum.

FIG. 4 illustrates an example configuration for the print drum 314 shown in FIG. 3. As indicated in FIG. 4, the drum 314 comprises a first drum zone 400 having a leading edge 402, a second drum zone 404 having a leading edge 406, a third drum zone 408 having a leading edge 410, and a fourth drum zone 412 having a leading edge 414. When media is loaded onto a particular zone of the drum 314, the printing device, and more particularly the loading control logic 212 (FIG. 2), attempts to align the leading edge of the media with the leading edge of that zone.

Returning to FIG. 3, once the print media reaches the drum 314, the media is loaded on the print surface 312 in alignment with a given drum zone. The media then rotates with the drum 314 in the direction of arrow 316 so that it passes under inkjet pens 318 that are used to eject droplets of ink onto the media. That ink is dried on the media using a dryer 320 that comprises one or more internal heating elements and one or more fans (not shown) that blow hot air over the media as it passes the dryer on the drum 314. After printing and drying have been completed, the media is removed from the drum 314 and is output from the printing device 100 along an output path 322 that comprises its own drive rollers 324.

In the embodiment of FIG. 3, the media sensor 206 comprises an optical sensor 326 that at least detects the leading edge of media loaded onto the print surface 312 of the drum 314. By way of example, the optical sensor 326 is a reflective optical sensor that comprises a light source and a light detector. The light source shines light toward the drum 314 that is reflected off of the drum surface 312 and is detected by the light detector, assuming the light is not absorbed by a sheet of media. Therefore, the optical sensor 326 can precisely determine when the media arrives at the optical sensor. Furthermore, given that the optical sensor 326 is calibrated to the physical features of the print drum, information obtained from the optical sensor can be correlated to positions on the drum, such as the leading edges of the various drum zones.

In the embodiment of FIG. 3, the drum position sensor 208 comprises an encoder 328 that monitors rotation of the drum 314 and therefore identifies the angular position of the drum. Through identification of the leading edge of the print media using the optical sensor 326 and the simultaneous identification of the drum position using the encoder 328, an error with which the media was loaded onto the drum 314 can be determined and, as described below, taken into account during later media loading.

Example systems having been described above, operation of the systems will now be discussed. In the discussions that follow, flow diagrams are provided. Process steps or blocks in these flow diagrams may represent modules, segments, or portions of code that include one or more executable instructions for implementing specific logical functions or steps in the process. Although particular example process steps are described, alternative implementations are feasible. Moreover, steps may be executed out of order from that shown or discussed, including substantially concurrently or in reverse order, depending on the functionality involved.

Figure 5:
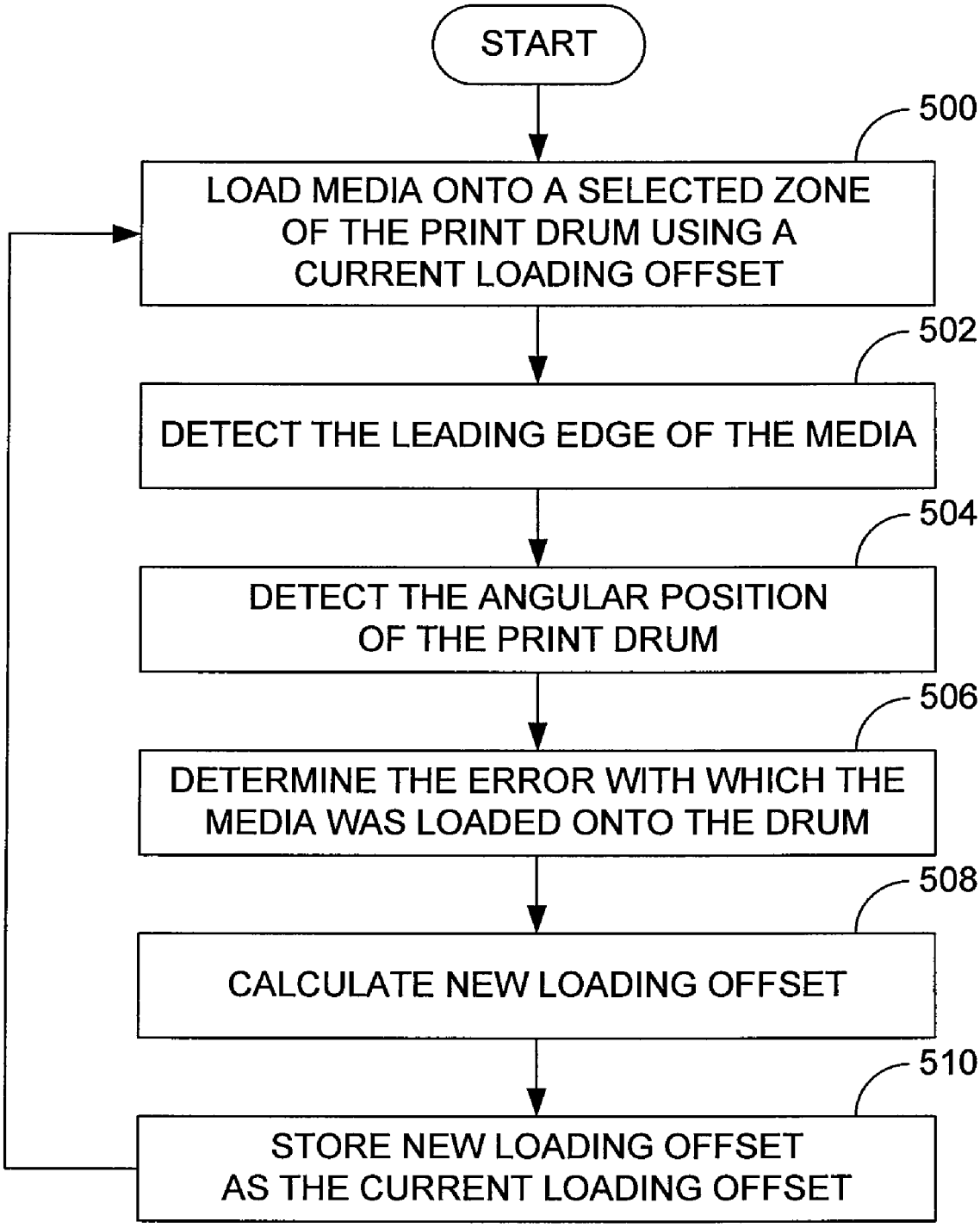
FIG. 5 is a flow diagram of an embodiment of a method for adjusting loading of media onto a print surface.

FIG. 5 illustrates an example method for loading media onto a printing surface. Beginning with block 500, media is loaded onto a selected zone of a print drum using a current loading offset. As mentioned above, the loading offset is a distance parameter used to adjust the position on the print drum surface at which the media is loaded. For instance, if the loading offset is a distance of +0.05 inches, indicating that previous print media was loaded such its leading edge was positioned behind the leading edge of the selected zone, the print media will be loaded onto the print drum surface at a position that is 0.05 inches in front of the position at which the media would otherwise have been loaded onto the print drum if the factors that affect loading accuracy were not taken into account. Therefore, in the orientation and rotation illustrated in FIG. 3, the media would be loaded onto the print drum surface 312 at a position that is 0.05 inches clockwise of the position at which the media would otherwise have been loaded onto the print drum. As described below in relation to FIG. 6, the loading offset need not comprise an actual distance. Instead, the loading offset can comprise an integer that is indicative of a distance and/or a position along the drum surface. Notably, if no previous calibration has been performed, for example if the printing device is new and is first being used, the current loading offset may be initially set to 0.

Next, the leading edge of the media is detected (block 502) as is the angular position of the print drum at the time the leading edge is detected (block 504). As described above, the leading edge and drum position can be detected using the aforementioned optical sensor and encoder, respectively. From the detected leading edge and the drum position, an error with which the media was loaded onto the drum can be determined, as indicated in block 506. In some embodiments, the loading error comprises the difference between the actual position of the leading edge of the media and the desired position of that leading edge in terms of the drum surface, i.e., the leading edge of the selected drum zone. For example, if the leading edge of the selected drum zone is located at a position that is 12.50 inches along the drum surface from a reference position and the media was loaded such that its leading edge actually was placed at the 12.51 inch position, the error is +0.01 inches.

Once the loading error has been determined, a new loading offset can be calculated, as indicated in block 508. In at least some embodiments, the new loading offset is calculated relative to the loading error determined in block 506 and at least one previous loading error. After the new loading offset has been calculated, it can be stored in printing device memory as the current loading offset, as indicated in block 510, and used during loading of the next media sheet. In some embodiments, a new loading offset is calculated for each sheet processed by the printing device such that the current loading offset is continually recalculated as printing is performed by printing device to enable continual adjustment media loading.

Figure 6:
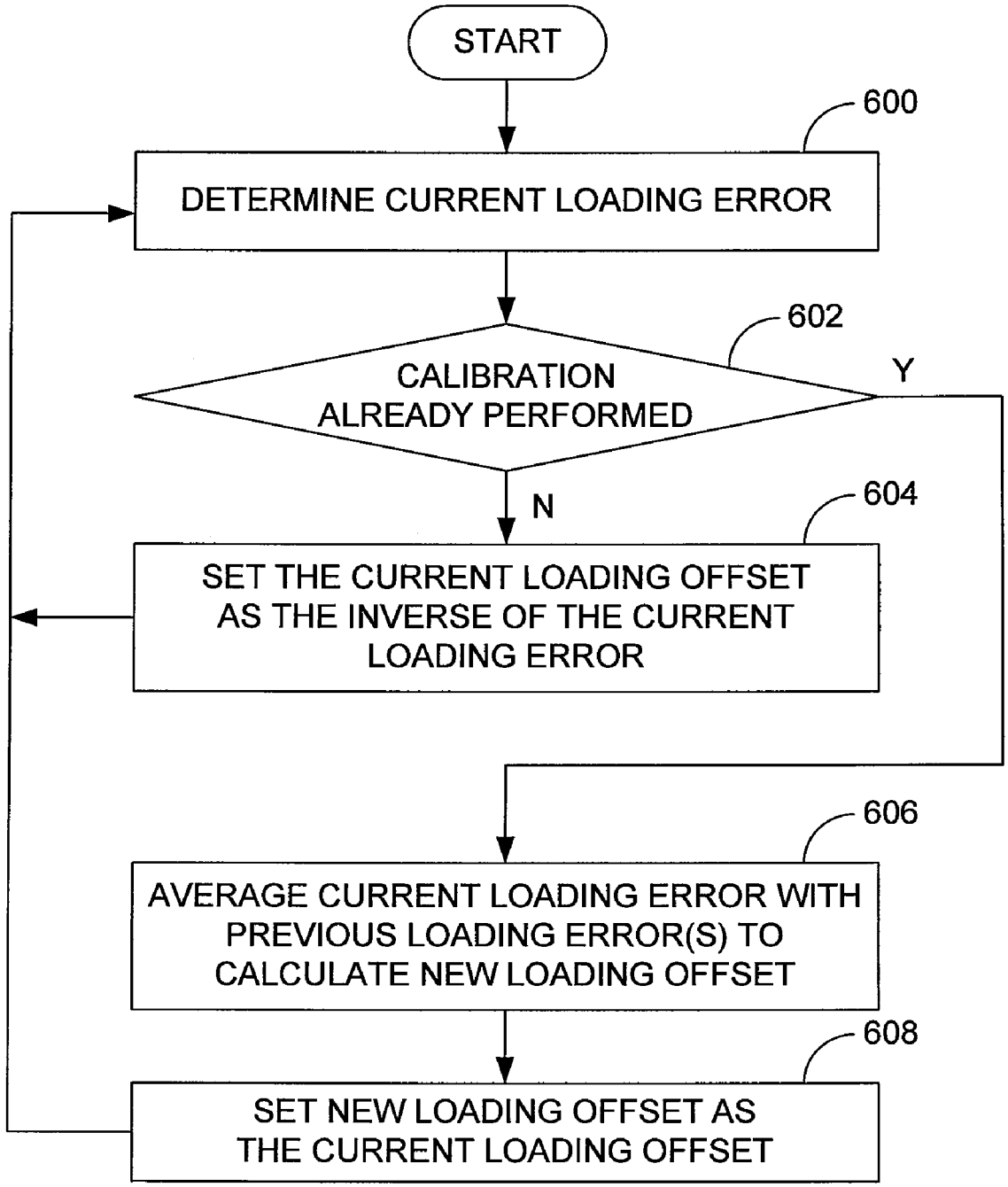
FIG. 6 is a flow diagram of an embodiment of a method for calculating a loading offset used in adjusting loading of media onto a print surface.

FIG. 6 illustrates an example method for calculating a new loading offset. Beginning with block 600, a current loading error is determined for a media sheet that has been loaded onto the print drum. As mentioned above, the loading error can comprise a distance parameter indicative of the distance to which a leading edge of the sheet of media has been misapplied to the print drum. More generally, all distances, and therefore positions, along the drum surface may be identified with such parameters. The parameters can be correlated with actual distances along the drum surface by dividing the parameter by a particular denominator. For example, if the denominator is 7200, which corresponds to 7200 hundredths of an inch, a distance parameter of 7200 identifies a position on the print drum that is one inch away from a reference point of the drum surface. In some embodiments, the reference point comprises the leading edge 402 of the first zone 400 identified in FIG. 4. In keeping with such a referencing schemes, example distance parameters or simply positions for the leading edges of the various zones can be as follows:

| Zone | Position |
|---|---|
| 1 | 0 |
| 2 | 89,334 |
| 3 | 178,670 |
| 4 | 133,261 |

In such an embodiment, the leading edges of Zones 2, 3, and 4 are respectively positioned approximately 12.41 inches, 24.82 inches, and 18.51 inches from the leading edge of Zone 1 (the reference point).

Assume that the print media is being loaded onto Zone 2 of the print drum as positioned above. In such a case, the leading edge of the media desirably will be applied to the print drum at position 89,334. If, for example, the leading edge of the media is actually determined to have been applied to the drum at position 88,950, the current loading error is (88,950-89,334), or −384.

With further reference to FIG. 6, it is determined whether any calibration has already been performed on the printing device, as indicated in block 602. If not, flow continues to block 604 at which the current loading offset is set as the inverse of the current loading error. In keeping with the example described above, the current loading offset would set to +384, meaning that the next media sheet would be loaded onto the print drum at a position that is 384/7200 inches forward of a position along the surface of the drum at which the media would be loaded if the offset were not used. Flow then returns to block 600 at which a new current loading error is determined.

Returning to decision block 602, if calibration has previously been performed, for example as in block 604, flow continues to block 606 at which the current loading error is averaged with previous loading errors to calculate a new loading offset. In some embodiments, the new loading offset is calculated using the following equation:

$$NewLoadingOffset = -\frac{(LE_{current} - LO_{current}) + LE_{previous}}{2} \quad \text{[Equation 1]}$$

where $LE_{current}$ is the current loading error, $LO_{current}$ is the current loading offset, and $LE_{previous}$ is the previous loading error. With Equation 1, the current loading error is first normalized relative to the current loading offset, and then the error is averaged with the previous error(s).

Assume next that the current loading offset is +384 as described above and that a second media sheet was loaded onto the print drum. If the media was this time determined to have been loaded onto Zone 2 of the print drum at position 89,400, the current loading error is (89,400-89,334), or +66. In that case, the new loading offset will be −((+66)−(+384)+(−384))/2, or +351.

Once the new loading offset is calculated, it is set as the current loading offset, as indicated in block 608, and flow can again return to block 600. Because calibration has been performed, flow will again return to block 606. Assume a loading error of +18 for the next (e.g., third) loaded media sheet. In that case, the new loading offset will be −((+18)−(+351)+−351)/2, or +342. In the embodiment of FIG. 6, flow continues in this manner with a new current loading offset being calculated for each loaded media sheet. Notably, however, the loading offset need not be recalculated for each media sheet.

As can be appreciated from the above, the loading offset can be continually recalculated to continually calibrate the printing device during its use. Such calibration can be separately performed for each of the zones of the drum to take into account any variation that may exist in their separate use. With such operation, the printing device can more accurately load media onto each of its drum zones using feedback in the form of measured loading error. Moreover, the printing device can continually adapt to changing conditions that may affect that accuracy, such as part wear, changes in print media, and changes in environmental conditions. Therefore, consistent performance can be obtained from the printing device throughout its useful life under a variety of conditions.

The invention claimed is:

1. A method for adjusting loading of media onto a print surface, the method comprising:

detecting a position of a sheet of media that has been loaded onto the print surface;

determining from the detected position a current loading error with which the media sheet has been loaded onto the print surface;

calculating a loading offset that can be used to adjust the position at which a future media sheet will be loaded onto the print surface; and adjusting the position at which a future media sheet is loaded onto the print surface a distance equal to the loading offset.

2. The method of claim 1, wherein detecting a position of a sheet of media comprises detecting a leading edge of the media sheet relative to the print surface.

3. The method of claim 2, wherein detecting a leading edge of the media sheet comprises detecting the leading edge with an optical sensor that shines light toward the print surface.

4. The method of claim 2, wherein the print surface is an outer surface of a print drum and wherein detecting a position of a sheet of media comprises detecting the leading edge of the media sheet relative to a leading edge of a zone of the drum.

5. The method of claim 4, wherein determining the current loading error comprises calculating the distance along the surface of the print drum between the media sheet leading edge and the drum zone leading edge.

6. The method of claim 5, wherein the location of the drum zone leading edge is determined using an encoder that provides an indication of an angular position of the print drum.

7. The method of claim 1, wherein calculating a loading offset comprises averaging the current loading error with a previous loading error.

8. The method of claim 7, wherein averaging comprises subtracting a current loading offset from the current loading error, adding the result of the subtraction to the previous loading error, and dividing by 2.

9. A system for adjusting loading of media onto a print surface, the system comprising:

means for detecting a position of a sheet of media that has been loaded onto the print surface;

means for determining a current loading error with which the media sheet has been loaded onto the print surface;

means for calculating a loading offset that can be used to adjust the position at which a future media sheet will be loaded onto the print surface; and means for adjusting the position at which a future media sheet is loaded onto the print surface a distance equal to the loading offset.

10. The system of claim 9, wherein the means for detecting a position of a sheet of media comprises an optical sensor that detects a leading edge of the media sheet relative to the print surface.

11. The system of claim 10, wherein the means for determining the current loading error comprise means for calculating a distance along the print surface between the media sheet leading edge and a predetermined feature of the print surface.

12. The system of claim 11, wherein the print surface is an outer surface of a print drum and wherein the means for determining the current loading error further comprise an encoder that provides an indication of an angular position of the print drum.

13. The system of claim 9, wherein the means for calculating a loading offset comprise means for averaging the current loading error with a previous loading error.

14. The system of claim 13, wherein the means for calculating a loading offset further comprise means for subtracting a current loading offset from the current loading error, adding the result of the subtraction to the previous loading error, and dividing by 2.

15. A printing device comprising:

a controller;

a print mechanism including a print drum;

memory that stores calibration logic configured to calculate a loading offset that can be used to adjust a position at which a media sheet will be loaded onto the print drum; and loading control logic configured to adjust the position at which media sheets are loaded onto the print surface a distance equal to the loading offset.

16. The printing device of claim 15, wherein the print mechanism further comprises a media sensor configured to detect a position of a sheet of media that has been loaded onto the print drum.

17. The printing device of claim 16, wherein the print mechanism further comprises a drum position sensor configured to provide an indication of an angular position of the print drum.

18. The printing device of claim 17, wherein the calibration logic is configured to determine a current loading error with which a media sheet has been loaded onto the print drum from information obtained by the media sensor and the drum position sensor.

19. The printing device of claim 18, wherein the calibration logic is configured to average the current loading error with a previous loading error.

20. The printing device of claim 19, wherein the calibration logic is configured to average by subtracting a current loading offset from the current loading error, adding the result of the subtraction to the previous loading error, and dividing by 2.

* * * * *